United States Patent [19]

Stanfield et al.

[11] Patent Number: 4,961,244

[45] Date of Patent: Oct. 9, 1990

[54] CLEANING ASSEMBLY FOR ELECTRICALLY CONDUCTING CLOSURES

[76] Inventors: Phillip W. Stanfield; Phillip L. Stanfield, both of 229 S. Locust St., Osborne, Kans. 67473

[21] Appl. No.: 217,403

[22] Filed: Jul. 11, 1988

[51] Int. Cl.[5] ..... A47L 5/24

[52] U.S. Cl. ..... 15/321; 15/302; 15/344

[58] Field of Search ..... 15/302, 321, 344; 68/18 F

[56] References Cited

U.S. PATENT DOCUMENTS

| | | | |
|---|---|---|---|
| 2,574,731 | 11/1951 | Dapprich | 15/302 X |
| 3,201,346 | 8/1965 | Benedict | 68/18 F |
| 3,262,146 | 7/1966 | Hays | 15/321 |
| 3,711,891 | 1/1973 | Conway | 15/321 |
| 3,775,053 | 11/1973 | Wisdom | 15/302 |
| 3,815,169 | 6/1974 | Mooring | 15/321 |
| 3,874,022 | 4/1975 | Wogoman et al. | 15/321 |
| 4,159,554 | 7/1979 | Knight et al. | 15/321 |

*Primary Examiner*—Frankie L. Stinson

*Attorney, Agent, or Firm*—Bill D. McCarthy

[57] ABSTRACT

A cleaning assembly for cleaning electrically conductive, flexible contact springs around the perimeter of a closure in a shield erected to prevent the passage of unwanted electromagnetic radiation. A pressurized solvent supply system and a vacuum recovery system are mounted in portable cabinet and each is connected via a flexible hose to a hand held cleaning head. The cleaning head comprises a trigger operated spray gun having a support block with a narrow vacuum recovery slot located immediately adjacent to and extending downwardly from the nozzle of the spray gun. The vacuum recovery slot is connected via an internal cavity in the support block to the hose leading to a vacuum recovery container.

4 Claims, 3 Drawing Sheets

CLEANING ASSEMBLY FOR ELECTRICALLY CONDUCTING CLOSURES

BACKGROUND OF INVENTION

1. Field of the Invention

The present invention relates generally to the field of cleaning devices, and more particularly but not by way of limitation, to a device which utilizes a high pressure stream of liquid solvent to clean electrically conducting closures and the like with minimum exposure to the surrounding atmosphere.

2. Discussion

Much electronic apparatus can be adversely affected by the presence of externally generated electromagnetic radiation. In addition, some electronic apparatus will itself generate undesirable electromagnetic radiation. This phenomenon is generally termed Electromagnetic Interference (EMI) or alternately, Radio Frequency Interference (RFI). EMI is a recently used term which includes the entire electromagnetic spectrum, whereas RFI is more restricted to the radio frequency band, generally considered to be between the limits 10 kHz to 10 GHz. EMI is defined as undesired conducted or radiated electrical disturbances, including transients, which can interfere with the operation of electrical or electronic equipment. Such disturbances can occur anywhere in the electromagnetic spectrum.

For a variety of reasons it becomes necessary during operation, testing, and adjusting of the electronic apparatus to provide shielding to prevent the unwanted incursion of externally generated radiation or the escape of radiation being emitted by the electronic apparatus. The electromagnetic disturbance can also be transmitted by conductance.

Since the electronic apparatus to be shielded is frequently installed in other, larger equipment such as aircraft, automotive vehicles and the like, the shielding can take the form of a large, totally enclosed room having numerous openings, such as doors for passage of personnel and equipment, air vents, and access panels for various utility services. For completely effective EMI shielding, each opening must be so designed that full electrical continuity is firmly established completely around its periphery when the opening is closed.

One method of achieving this electrical continuity is to provide a tongue of electrically conductive material around the perimeter of the door, the tongue extending perpendicularly into the plane of the opening in such a manner so that when the door is closed, the tongue will penetrate into a matching slot in the wall surrounding the opening. The recessed cavity of the slot is fitted with a plurality of flexible, electrically conductive springs, usually beryllium copper, phosphor bronze, or the like. Thus, when the door is closed, electrical continuity is achieved and EMI shielding is complete.

Very large shielded rooms, as required to accommodate aircraft and the like, require openings so large that hinged doors are impractical; in these cases, sliding or roll-up type closures are used. In order to achieve the same degree of EMI shielding afforded by the tongue and slot method used on hinged doors, the inside surface of the door jamb is equipped with an electrically conducting metal plate on which are mounted a plurality of rows of flexible, electrically conducting springs. An inflatable bladder is installed behind the metal plate; when the door is closed, the bladder is inflated and the flexible, electrically conducting springs are pushed into contact with an electrically conducting strip, usually made of brass or the like, on the outer periphery of the door, thus achieving full electrical continuity and the required EMI shielding.

Over a period of time, dust and dirt can accumulate in the slot, and the conductive springs can become oxidized or otherwise corroded, resulting in a loss of electrical continuity and a diminution of EMI shielding. To insure the integrity of the shielding system, it is necessary to meticulously clean all of the slots surrounding the openings and the electrically conducting springs on a regular periodic basis. Heretofore, this cleaning has required much manual labor, involving hand scrubbing of the springs in the slot with a solvent soaked cloth wrapped around a spatula such as a putty knife. The electrically conducting springs, both in the recessed cavity and on the bladder plate, are rather fragile and highly susceptible to damage and permanent deformation during this hand cleaning process. It is to eliminate this manual cleaning that the present invention is directed.

SUMMARY OF INVENTION

The present invention provides a portable closure cleaning assembly comprising a solvent supply system and a vacuum recovery system, both of which are connected by flexible hoses to a hand held cleaning head. The cleaning head is a liquid spray gun to which is attached a cleaning head support block. The cleaning head support block has a narrow vacuum slot located immediately adjacent to and extending downwardly from the spray gun nozzle. The vacuum slot is connected via an internal cavity to the end of a flexible hose leading to the vacuum recovery system.

The solvent supply system comprises a solvent supply reservior connected by a supply hose to a high pressure solvent pump the output of which is passed via a flexible hose to the hand held cleaning head.

The vacuum recovery system is connected to the support block of the cleaning head, and has a quantity of activated carbon through which vapors are passed before being exhausted.

In operation, the solvent pump fills the supply hose with solvent under high pressure and a vacuum is created at the support block. The cleaning head is positioned so that it releases a stream of solvent that impinges upon electrically conducting springs with considerable force, and the mechanical and chemical action of the chlorinated hydrocarbon solvent removes accumulated contaminants from the surface of the springs. The close proximity of the vacuum slot to the nozzle of the spray gun causes nearly all discharged solvent and the resulting vapors to be immediately captured and transported to the vacuum intake container, leaving the electrically conducting springs having fresh surfaces.

The objects, advantages and features of the present invention will become clear from the following detailed description when read in conjunction with the drawings and appended claims.

BRIEF DESCRIPTION OF THE DRAWINGS

FIG. 6 is a partial plan view of the cleaning head of FIG. 5.

DESCRIPTION

Like numerals and characters designate like elements throughout the figures of the drawings.

Figure 1:
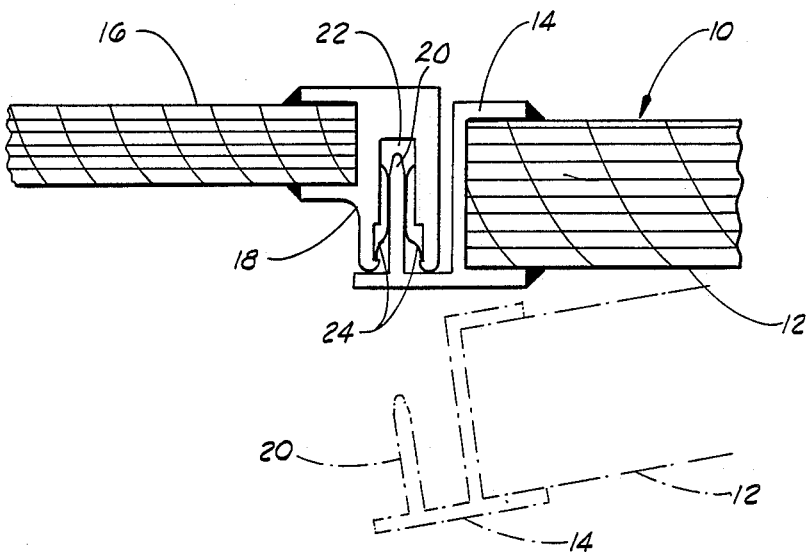
FIG. 1 is a partially detailed, top cross sectional view of a portion of a closure mechanism of the type to be cleaned by the present invention.

Reference is initially directed to FIG. 1, which depicts a semi detailed, cross sectional plan view of a closure mechanism 10 of the type to be cleaned by the present invention. A door 12 of the closure mechanism 10 is fitted completely around its perimeter with an edge sealing conductor 14, and a wall 16 surrounding the door 12 is fitted with a mating edge sealing conductor 18. The edge sealing conductor 14 has an electrically conducting tongue member 20 (shown in the phantom line view of the door 12 depicting rotation of same to its open position), when the door 12 is in the closed position, the electrically conducting tongue member 20 fits into a slot 22 of edge sealing conductor 18 and makes electrical contact with flexible contact springs 24 supported within the slot 22. Dust, dirt, oxidation and other corrosion on the springs 24 can result in imperfect electrical contact with the tongue member 20, and consequently, in degradation of EMI shielding efficiency of the closure mechanism 10. The present invention provides an improved apparatus and method to remove this dust, dirt and corrosion with a minimum of manual labor.

Figure 2:
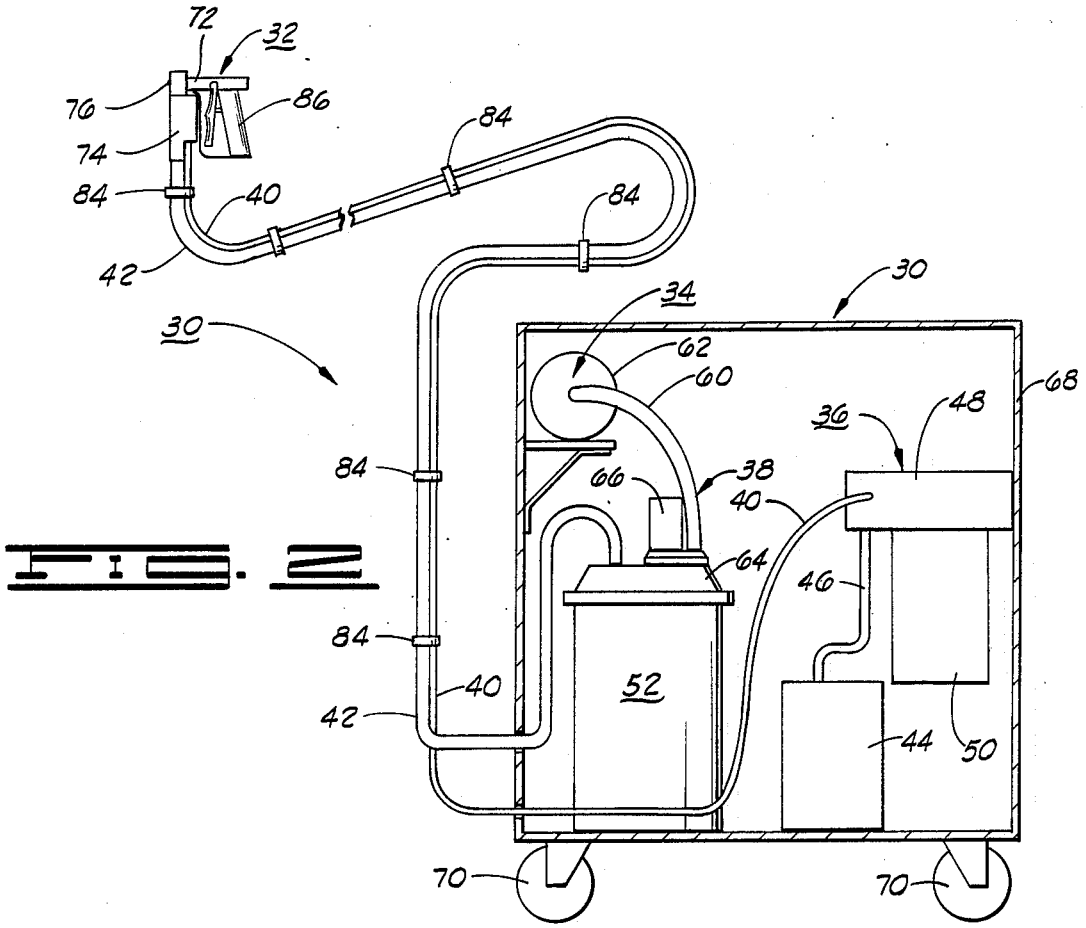
FIG. 2 is a front elevational view of a closure cleaning assembly constructed in accordance with the present invention. For clarity, the cabinet doors, electric wiring and controls are not shown.

Reference is now directed to FIG. 2, which shows a front elevational view of a cleaning assembly 30, constructed in accordance with the present invention and having a cleaning head 32 and a solvent dispensing and collecting assembly 34. The collecting assembly 34 consists of two major elements: a solvent pumping system 36 and a vacuum recovery system 38. The cleaning head 32 is connected to the solvent pumping system 36 by a pressurized solvent hose 40 and to the vacuum recovery system 38 by a vacuum hose 42.

The solvent pumping system 36 consists of a solvent supply reservoir 44 connected by a solvent suction hose 46 to a solvent pump 48 driven by an electric motor 50. The output of the solvent pump 48 passes to the solvent hose 40 and thus conveyed to the cleaning head 32.

Figure 3:
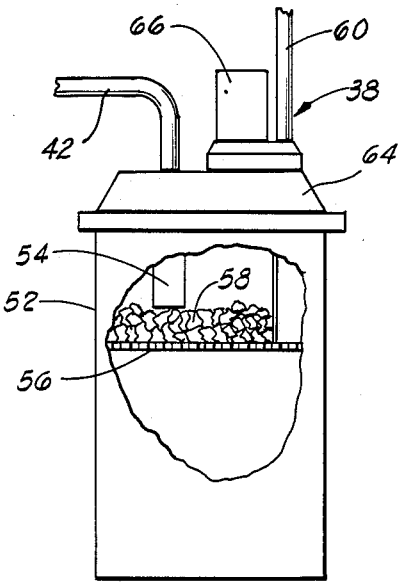
FIG. 3 is a partially cutaway, enlarged front elevational view of a portion of the vacuum recovery system of the present invention.

FIG. 3 is an enlarged portion of the vacuum recovery system 38 in partial cutaway depiction. The flexible vacuum hose 42 is connected to a vacuum intake container 52 via a vacuum intake conduit 54 which extends into the vacuum intake container 52 and terminates above an internal screen shelf 56. The screen shelf 56 holds a quantity of activated charcoal 58 and is mounted in such a position that solvent liquid and vapor drawn into the container must pass through the bed of charcoal 58. An exhaust hose 60 leads from the vacuum intake container 52 and is connected to an external cannister 62 (FIG. 2) which is also filled with activated charcoal to capture any remaining potentially noxious vapors prior to exhaustion to the atmosphere via a cannister exhaust port (not shown).

The vacuum intake container 52 has a covering lid 64 which supports the vacuum intake conduit 54 and an electrically powered blower unit 66 which serves to air evacuate the vacuum intake container 52 and to maintain a negative pressure therein. The exhaust hose 60 connects the output port of the blower unit 66 to the input of the external cannister 62. The covering lid 64, attached to the vacuum intake container 52 by connectors (not shown), is removable to empty the vacuum intake container 52 of liquid accumulated in the bottom thereof. As one will recognize, a conventional industrial type vacuum cleaner can be readily modified to provide many of the functional components described herein that make up the vacuum recovery system 38.

For conveniently providing portability to the cleaning assembly 30, the solvent pumping 36 and vacuum recovery system 38 are mounted in a cabinet 68 which is supported on several caster members 70. Appropriate electrical wiring and controls are not shown in the figures, as such will be known to a person of ordinary skill in the electrical art. Also, the cabinet doors are removed in FIG. 2 to expose the interior components.

Figure 4B:
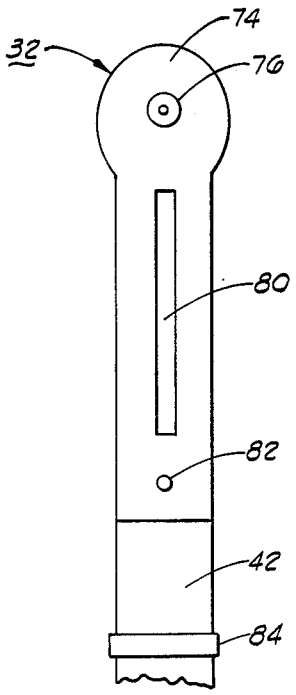
FIG. 4B is a front view of the cleaning head of FIG. 2.
Figure 4A:
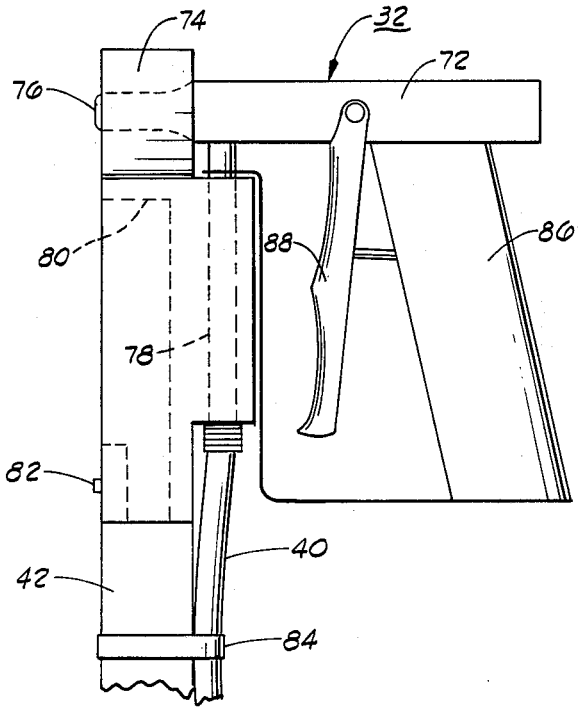
FIG. 4A is an enlarged, side elevational view of the cleaning head shown in FIG. 2.

FIGS. 4A and 4B are enlarged side and front elevational views of the cleaning head 32, respectively. The cleaning head 32 is comprised of a liquid spray gun 72 mounted to a cleaning head support block 74. The spray gun 72 has a spray gun nozzle 76 which extends through the cleaning head support block 74. A rigid tube 78 (shown in phantom) is attached to the inlet port of the spray gun 72 and extends through the support block 74, thus securely interconnecting the spray gun 72 and the support block 74.

The support block 74 has a vacuum slot 80 located in close proximity to the spray gun nozzle 76 and extends downwardly therefrom. The interior of support block 74 is hollow appropriately shaped to provide fluid communication with the vacuum hose 42 connected thereto so that suction is created at vacuum slot 80. A slot guide 82 is provided to help the operator align the cleaning head directly over the closure slot being cleaned. The vacuum hose 42 and the solvent hose 40 are bound together with clips 84 or the like to facilitate ease of handling.

The spray gun 72 is a conventional liquid spray unit manufactured and available from many sources for spraying liquids, such as, for example, paint. It will therefore be unnecessary to describe the spray gun 72 in internal detail, but it will be noted that it has a handle portion 86 and a trigger 88. Operation of the spray gun 72 is achieved, when the spray gun 72 is held in an operator's hand via the handle portion 86, by depressing the trigger 88 which results in high pressure solvent, supplied via the solvent hose 40, being discharged with high velocity from the spray gun nozzle 76.

In operation of the cleaning assembly 30, a supply of an appropriate solvent (not shown) is placed into the reservior 44. The solvent is usually a chlorinated hydrocarbon such as perchlorethylene, 1—1—1 trichlorethane (methylchloroform), or the like. Electrical power is applied to the motor 50 and to the blower unit 66, thus sending solvent under pressure through the solvent hose 40 to the cleaning head 32 and simultaneously creating a vacuum in slot 80 via the vacuum hose 42.

The cleaning head 32 is positioned over the slot 22 to be cleaned and the trigger 88 is depressed. A stream of solvent is discharged under considerable force from the nozzle 76 and is caused to impinge the contact springs 24 disposed in the closure slot 22; and this high velocity solvent scrubs away and dissolves contaminants. The discharged solvent is immediately sucked into the vacuum slot 80. Since the vacuum slot 80 is immediately adjacent and directly under the nozzle 76, nearly all of the solvent is recaptured, and returns through vacuum hose 42 to the vacuum intake container 52. Vapors accompanying the recovered solvent are caused to pass through the activated charcoal 58 (shown in FIG. 3) before reaching exhaust hose 60. The exhaust hose 60 is connected to the external cannister 62 which also has a bed of activated carbon (not shown) through which the withdrawn solvent vapors are passed; thus the solvent vapors are captured so as not to be ejected into the atmosphere.

In operation, when the electrical power is energized, the solvent pump fills the supply hose with solvent under high pressure and a vacuum is created at the narrow slot of the support block. The cleaning head is positioned so that the slot guide is lightly inserted into, or abutted against, a door slot, thus aligning the cleaning head with the door slot. The spray gun is trigger depressed, and a stream of solvent impinges upon the springs with considerable force. The mechanical action of the high velocity liquid and the chemical action of the chlorinated hydrocarbon solvent combine to remove accumulated dust, dirt and products of oxidation and corrosion from the surface of the springs and flushes them into the cavity surrounding the springs.

The close proximity of the vacuum recovery slot to the exit nozzle of the spray gun causes nearly all of the dirt, the solvent and the resulting vapors to be immediately captured and transported to the vacuum intake container, leaving the springs having a fresh, clean and electrically conducting surface without having to manually scrub them.

Figure 5:
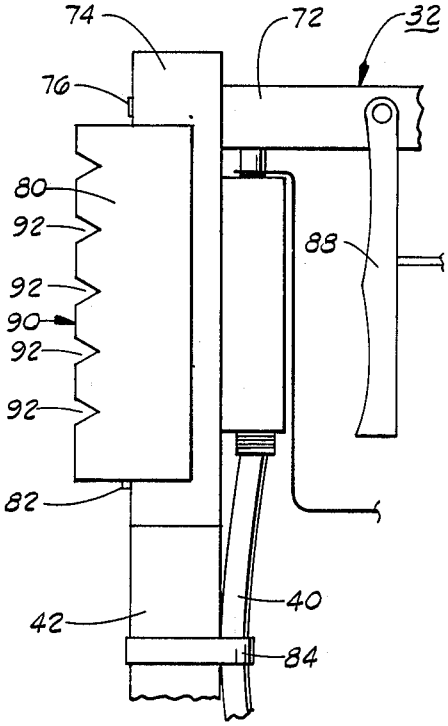
FIG. 5 is a partial side elevational view of the cleaning head of FIG. 2 with an empty cavity attachment supported thereon.
Figure 5:
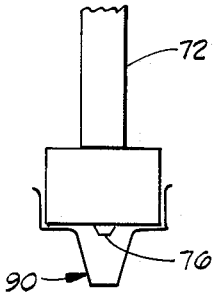

Returning to FIG. 1, it will be appreciated that the surface of the door frame slot 22 must be free from dirt and corrosion with the flexible springs 24 removed from the edge sealing conductor 18, that is, prior to mounting the flexible springs 24 in the door frame slot 22. This is accomplished through the use of an enhanced embodiment of the present invention which is depicted in the partial side elevational view in FIG. 5 and in the partial plan view in FIG. 6. An empty cavity attachment 90 is clipped to the cleaning head support block 74 so that it essentially covers the vacuum slot 80. In the preferred embodiment, the empty cavity attachment 90 is constructed of a sufficiently sturdy metal that can be used to guide the cleaning head 32 along the door frame slot while maintaining good alignment of the vacuum slot 50, and the empty cavity attachment 90 is provided with a number of vacuum slots 92 along its forward edge as shown. Good alignment of the cleaning head 32 with vacuum slot 80 prevents potential injury to operating personnel from excessive splashing of the high velocity solvent stream.

Figure 7:
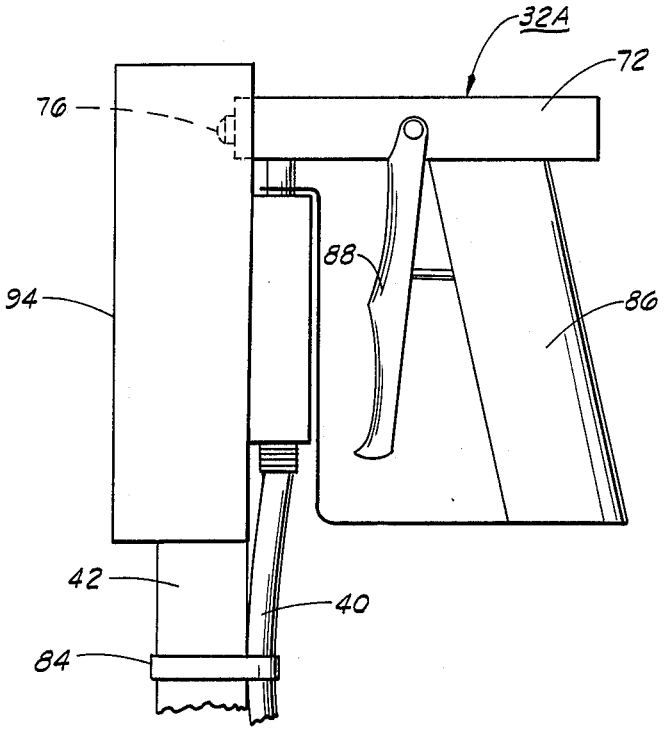
FIG. 7 is a side elevational view of another embodiment of a cleaning head for the closure cleaning assembly of the present invention.
Figure 8:
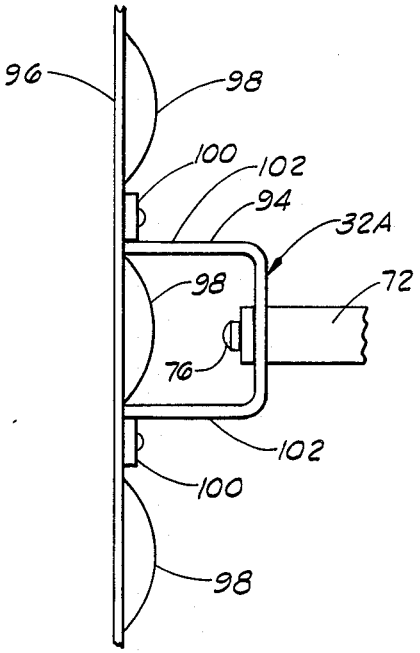
FIG. 8 is a plan view of the cleaning head of FIG. 7.

Reference is now directed to FIGS. 7 and 8, which show two views of another embodiment of the present invention in the form of the cleaning head 32A. The cleaning head 32A is provided with a modified cleaning head support block 94 to accommodate the flexible contact springs mounted on the support plate of a bladder type door closure. In contrast to the tongue-and-matching-slot arrangement previously described, the bladder type door closure is provided with a rigid plate 96 (FIG. 8) to which is mounted a plurality of flexible contact springs 98 in regularly spaced parallel rows, the springs 98 fastened thereto via spring fasteners 100. The spray shield type cleaning head support block 94 is designed to have standoff sides 102 to extend an appropriate distance beyond the spray gun nozzle 76, and the sides 102 are suitably spaced so as to be received between two adjacent rows of spring fasteners 100, thereby forming a small chamber over a portion of the springs 98. The support block sides 102 can thus be aligned with the springs 98 and the entire cleaning head 32A slidably moved along the flexible contact springs 98 to clean same.

It will be clear that the present invention is well adapted to carry out the objects and attain the advantages mentioned as those inherent therein. While presently preferred embodiments of the invention have been described for purposes of this disclosure, numerous changes can be made which will readily suggest themselves to those skilled in the art and which are encompassed within the spirit of the invention disclosed and as defined in the appended claims.

What is claimed is:

1. A cleaning assembly for cleaning and maintaining electrically conductive closure members wherein one of the closure members is provided with a tongue portion having edge sealing conductors and the other of the closure members defines a closure slot having edge sealing conductors disposed within the closure slot, the closure member defining the closure slot adapted to matingly receive the tongue portion of the other closure member, the cleaning assembly comprising:

spray gun having a nozzle and a hand operated trigger to selectively discharge a high velocity stream of solvent from the nozzle onto the surfaces of the edge sealing conductors in closure slot;

a support block supported by the spray gun, the support block having an elongated slot extending through one side thereof, and an internal cavity communicating with the elongated slot, the support block connectable to a vacuum source via the internal cavity such that solvent discharged from the nozzle is captured and recovered when the support block is positioned on the closure member defining the closure slot and the elongated slot in the support block is aligned with the closure slot.

2. The cleaning assembly of claim 1 further comprising:

slot means supported on the support block and positionable in closure slot for aligning the the elongated slot of the support block with the closure slot.

3. The cleaning assembly of claim 1 wherein the support block is provided with a nozzle receiving bore extending therethrough, the nozzle receiving bore adapted to receive the nozzle of the spray gun such that the nozzle is aligned with the elongated slot and disposed substantially adjacent one end thereof.

4. The cleaning assembly of claim 1 further comprising:

attachment means for cleaning the closure slot prior to installation of the edge sealing conductors, the attachment means connectable to the support block so as to substantially cover the elongated slot therein, the attachment means having a plurality of vacuum slots along its forward edge for establishing communication with the elongated slot of the support block and a configuration conforming to the closure slot to enhance guiding of the support block, the nozzle and the spray gun along the closure slot.

* * * * *